US005347889A

United States Patent [19]

St. Denis

[11] Patent Number: 5,347,889

[45] Date of Patent: Sep. 20, 1994

[54] MULTI-PURPOSE WINE BOTTLE STOPPER DEVICE

[76] Inventor: Andrew R. St. Denis, 5331-5th Concession, Amherstburg, Ontario, Canada, N9V 2Y9

[21] Appl. No.: 164,792

[22] Filed: Dec. 10, 1993

Related U.S. Application Data

[63] Continuation-in-part of Ser. No. 46,816, Apr. 16, 1993, Pat. No. 5,275,070.

[51] Int. Cl.[5] ..... B67B 7/02

[52] U.S. Cl. ..... 81/3.29; 81/3.09; 81/3.37; 81/3.44

[58] Field of Search ..... 81/3.29, 3.36, 3.4, 81/3.07, 3.44, 3.37, 3.09, 3.45

[56] References Cited

U.S. PATENT DOCUMENTS

| | | | |
|---|---|---|---|
| 2,732,741 | 1/1956 | Muller-Strobel | 81/3.41 |
| 2,761,338 | 9/1956 | Hardy | 81/3.38 |
| 4,442,735 | 4/1984 | Chance et al. | 81/3.44 |
| 4,606,245 | 8/1986 | Veverka et al. | 81/3.36 |
| 4,708,033 | 11/1987 | Eash | 81/3.37 |
| 4,756,214 | 7/1988 | Valtri et al. | 81/3.4 |
| 5,000,063 | 3/1991 | Federighi, Sr. | 81/3.37 |

*Primary Examiner*—Roscoe V. Parker

[57] ABSTRACT

A device is described for removing either a cork or a mushroom-shape stopper from a bottle. It includes a support frame having a bottom ring member adapted to engage the neck of a wine bottle, a top cap member with a threaded hole extending therethrough and at least two circumferentially spaced longitudinal support members extending between the top cap and bottom ring. A threaded shaft having an upper end and a lower end is mounted in the top cap threaded hole, this shaft having a handle mounted on the upper end thereof. A stopper gripping and pulling member is included for a mushroom-shaped stopper comprising a bridge member her connected to the lower end of the threaded shaft such that the threaded shaft is free to rotate relative to the bridge member while being fixed against relative axial movement, guideways in the bridge member for receiving the support frame longitudinal support members thereby preventing rotation of the bridge member, a pair of opposed stopper gripping arms extending downwardly from the bridge member, these gripping arms having at the lower ends thereof inwardly extending gripper dogs adapted to slide downwardly over the top of a mushroom-shaped stopper in a bottle and grip the stopper for pulling and these gripper arms being further adapted to swing outwardly from the bridge member to release a pulled stopper. Also included is a cork pulling member comprising a stem portion with a handle at one end and cork screw portion at the other end, the cork screw stem extending through an axial hole in the threaded shaft with the cork screw handle projecting above the threaded shaft handle, the cork screw member being adapted to be screwed into a cork in a bottle by turning the cork screw handle and being adapted to pull the cork from the bottle by turning the handle of the threaded shaft whereby the thread shaft handle engages the cork screw handle thereby lifting the cork screw and cork.

6 Claims, 3 Drawing Sheets

MULTI-PURPOSE WINE BOTTLE STOPPER DEVICE

CROSS-REFERENCE TO RELATED APPLICATION

This application is a continuation-in-part of U.S. application Ser. No. 08/046,816 filed Apr. 16, 1993, now U.S. Pat. No. 5,275,070.

BACKGROUND OF THE INVENTION

This invention relates to a device for removing a stopper from a bottle, and more particularly, for removing either a cork or a mushroom-shaped stopper from a wine bottle.

It is now commonplace to use a form of plastic stopper for wine bottles, particularly sparkling wine or champagne bottles. These plastic stoppers have the advantage of being very inexpensive, but they do present problems that are avoided with traditional bottle corks. Thus, when removing traditional corks, a cork screw is turned into the cork for pulling and this not only provides a pulling means but also a means for controlling the cork from flying when released from the bottle. It is not possible to use a cork screw with a plastic stopper and, therefore, these stoppers are formed with a bulbous head as a means for grasping the stopper for pulling. Because this is not a very efficient means for pulling, it is commonplace to form the stopper with a relatively loose fit in the bottle and provide a wire cage over the bulbous head to hold the stopper from accidentally releasing due to pressure in the bottle. This pressure may be as high as 40 psi. Also, when the plastic stopper is released it frequently becomes a dangerous projectile with the release of gas pressure in the bottle and has caused serious eye injuries. Because the plastic stopper is a dangerous projectile, some wine makers for safety reasons actually use much more expensive mushroom-shaped stoppers formed from cork. A cork stopper inflicts much less damage as a projectile than does a plastic stopper.

There is still a need for a very simple and inexpensive device which is very easy to use and which is capable of removing a plastic bottle stopper without allowing the stopper to become a projectile. To be commercially viable, the device must also be very easy to use, while being formed from a bare minimum of plastic parts.

Numerous devices have heretofore been proposed for removing stoppers from bottles. A particularly significant design is that shown in U.S. Pat. No. 4,756,214 which issued Jul. 12, 1988. The device of this patent goes a long way to meeting the above criteria in terms of safety but it remains a relatively complicated device including a slidable collar to permit engagement with the mouth of the bottle.

An example of the use of a wire cage to prevent accidental release of a stopper is shown in U.S. Pat. No. 4,708,033. Because a stopper will sometimes pop out by itself when the wire cage is removed, it is important that the stopper pulling device be designed such that the wire cage can be loosened after the pulling device has been placed on the bottle.

Of course, the traditional cork is also widely used for wine bottles and it would be most convenient if there could be a single stopper removing device which would be capable of removing either a traditional wine bottle cork or the mushroom-shaped plastic stoppers.

It is a primary object of this invention to provide a stopper pulling device which is capable of pulling either a traditional cork or a mushroom-shaped plastic stopper from a bottle.

It is a further object of the present invention to provide a dual purpose stopper pulling device particularly for wine bottles which will not only be convenient and safe to use, but also be simple and very inexpensive to manufacture thereby making it readily accessible to all wine consumers.

SUMMARY OF THE INVENTION

The present invention relates to a device for removing either a cork or a mushroom-style stopper from a bottle. It includes: (a) a support frame having a bottom ring member adapted to engage the neck of a wine bottle, a top cap member with a threaded hole extending therethrough and at least two circumferentially spaced longitudinal support members extending between the top cap and bottom ring, (b) a threaded shaft having an upper end and a lower end mounted in said top cap threaded hole, this shaft having a handle mounted on the upper end thereof, (c) a stopper gripping and pulling member for a mushroom-shaped stopper comprising a bridge member connected to the lower end of said threaded shaft such that the threaded shaft is free to rotate relative to the bridge member while being fixed against relative axial movement, guideways in said bridge member for receiving said support frame longitudinal support members thereby preventing rotation of said bridge member, a pair of opposed stopper gripping arms extending downwardly from said bridge member, said gripping arms having at the lower ends thereof inwardly extending gripper dogs adapted to slide downwardly over the top of a mushroom-shaped stopper in a bottle and grip the stopper for pulling and these gripper arms being further adapted to swing outwardly from said bridge member to release a pulled stopper, and (d) a cork pulling member comprising a stem portion with a handle at one end and cork screw portion at the other end, said cork screw stem extending through an axial hole in said threaded shaft with the cork screw handle projecting above said threaded shaft handle, said cork screw member being adapted to be screwed into a cork in a bottle by turning the cork screw handle and being adapted to pull the cork from the bottle by turning the handle of the threaded shaft whereby the thread shaft handle engages the cork screw handle thereby lifting the cork screw and cork.

According to a preferred feature, a disc member is attached to the lower end of the threaded shaft and this disc member has an axially upwardly extending collar which is received in a hole in the bridge member, thereby permitting rotation of the shaft relative to the bridge member. Preferably, the disc member is permanently fixed to the lower end of the threaded shaft, while the handle is removably attached to the top end. In this way, the threaded shaft can be passed through the hole in the bridge member before the handle is connected and resilient tabs can be provided projecting from the threaded shaft to prevent axial movement of the bridge along the shaft.

The cork pulling member extends downwardly through holes in the threaded shaft, the handle thereof and the bottom disc. Preferably, the cork pulling member includes at the upper end of the stem a shoulder portion adapted to press against the threaded shaft handle during the cork pulling operation.

The bridge member is preferably provided with lines of weakness forming self-hinges permitting the gripper arms to swing outwardly and release a pulled stopper.

All parts of the device of this invention can be conveniently made from a variety of injection mouldable plastic materials, but a strong plastic such as DERLIN® is preferred.

BRIEF DESCRIPTION OF THE DRAWINGS

In the drawings which illustrate the present invention.

DESCRIPTION OF PREFERRED EMBODIMENTS

Figure 1:
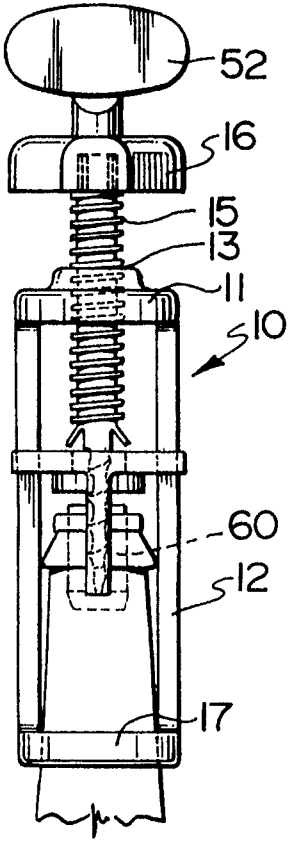
FIGS. 1, 2, 2*a* and 3 are side elevational views of embodiments of the device of the invention.
Figure 2:
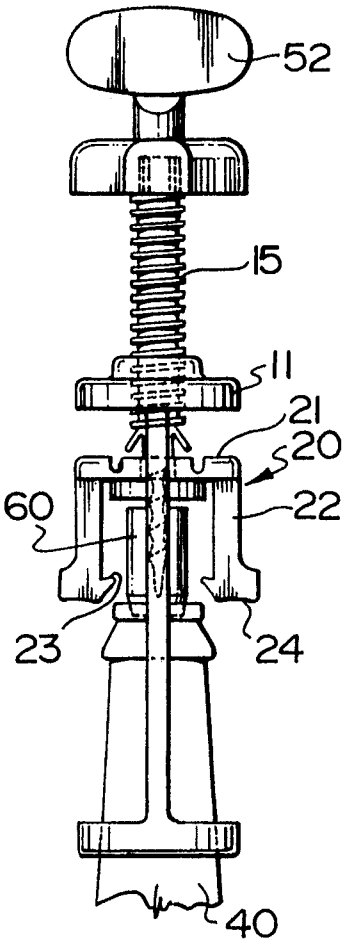
Figure 2A:
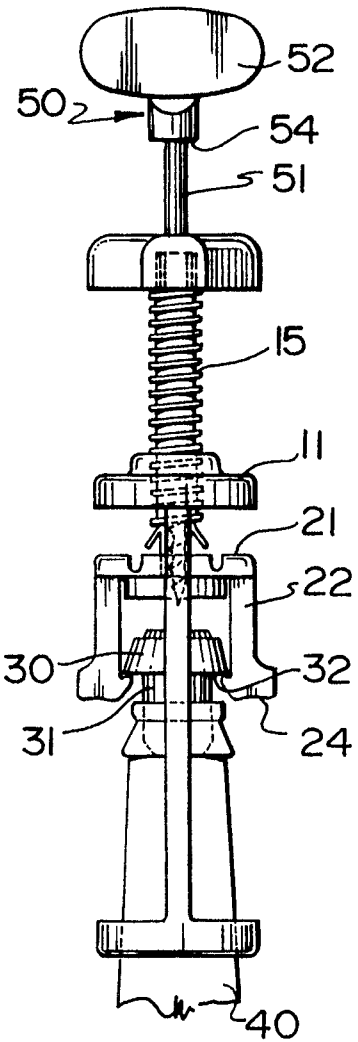
Figure 3:
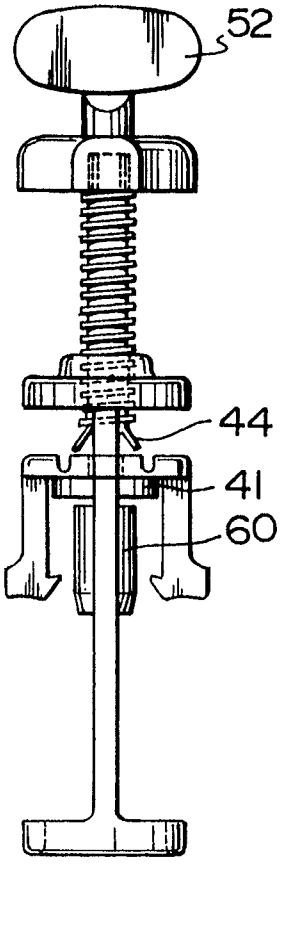
Figure 4:
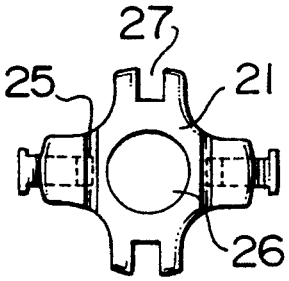
FIG. 4 is a plan view of a gripping unit.
Figure 5:
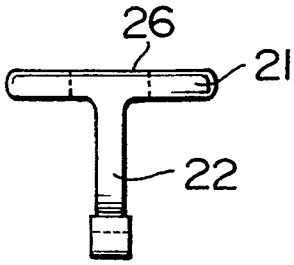
FIG. 5 is a side elevational view of a gripping unit.
Figure 6:
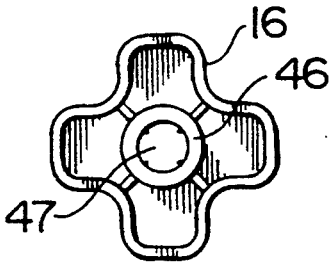
FIG. 6 is a bottom plan view of the handle for the threaded shaft.

Typical examples of the stoppers that can be removed with the device of this invention are shown in FIGS. 1–3. Thus, the stopper 60 shown in FIGS. 1, 2 and 3 is a traditional cylindrical natural cork stopper that can be removed from a bottle only by means of a corkscrew which is turned into the cork. FIG. 2*a* shows a typical mushroom-shaped stopper of the type typically found in champagne and sparkling wine bottles. These stoppers are typically made of plastic materials with a bulbous top portion 30, a cylindrical stopper portion 31 and a shoulder 32 formed between the top portion 30 and the stopper 31. Of course, these plastic stoppers cannot be removed by a traditional corkscrew. The apparatus of the present invention pulls both of the above types of bottle stoppers with ease.

Figure 7:
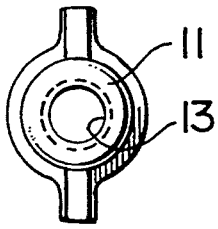
FIG. 7 is a top plan view of a frame portion.
Figure 8:
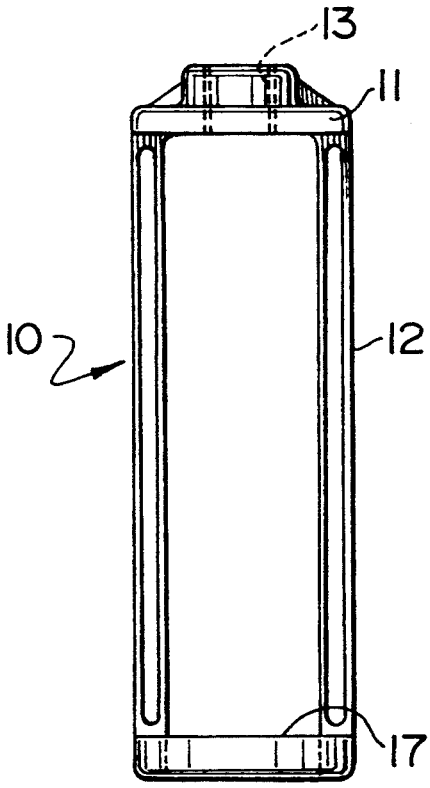
FIG. 8 is one side elevation of the frame portion.
Figure 9:
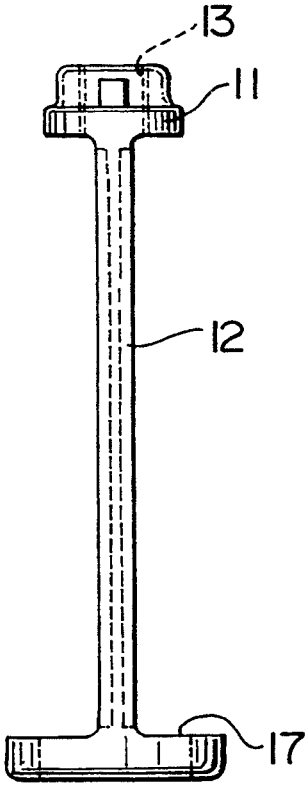
FIG. 9 is a second side elevation of the frame portion.

There are four main components to the device of the invention, these being (1) a support frame, (2) a threaded shaft with handle, (3) a stopper gripping and pulling member and (4) a cork screw and puller. The support frame 10 includes a bottom ring member 17 adapted to slide down onto and engage a wine bottle neck 40. The frame also includes a top cap member 11 with a threaded hole 13 extending therethrough. The ring 17 and cap 11 are joined by means of at least two longitudinal support members or rods 12. The structure of this support frame can best be seen from FIG. 7, 8 and 9.

A threaded hollow shaft 15 extends downwardly through the threaded hole 13 in top cap 11. A handle 16 is affixed to the top end of shaft 15 while the lower end of the shaft is rotatably connected to the stopper gripping and pulling member 20.

Figure 10:
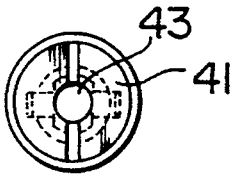
FIG. 10 is a bottom plan view of a threaded shaft assembly.
Figure 13:
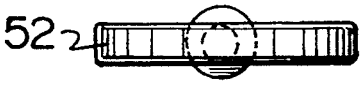
FIG. 13 is a top plan view of a corkscrew.
Figure 11:
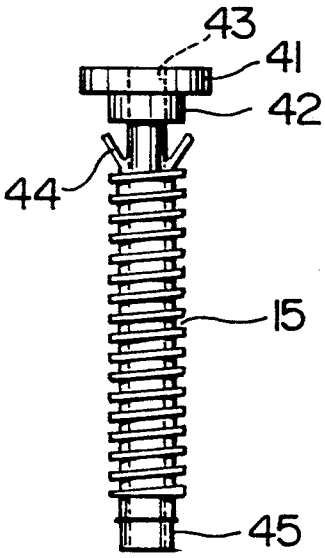
FIG. 11 is a side elevational view of the threaded shaft assembly.
Figure 12:
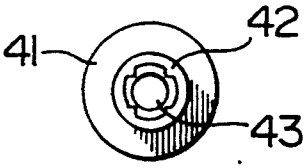
FIG. 12 is a top plan view of the threaded shaft assembly.
Figure 14:
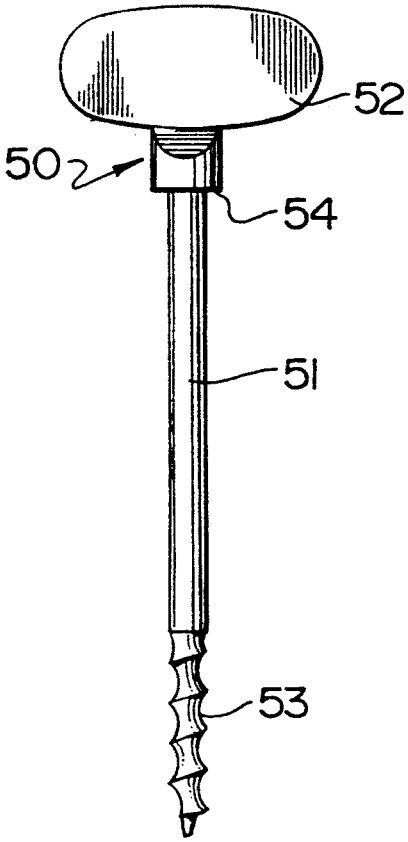
FIG. 14 is a side elevational view of the corkscrew.

The stopper gripping and pulling member 20 (referred to hereinafter as the gripper) includes a top or bridge member 21 with gripper arms 22 extending downwardly therefrom. The gripper arms 22 have inwardly extending gripping dogs 23 and the bottom ends of the gripping arms have concave faces 24. The top or bridge portion 21 has a central hole 26 for mounting to the bottom end of threaded shaft 15. This mounting is achieved by means of a mounting disc 41 as shown in FIGS. 10–12. This disc 41 includes an upwardly extending annular shoulder portion 42 which fits into hole 26 in bridge portion 21 of gripper 20 and serves as a pivot. The disc 41 and shoulder portion 42 are preferably permanently connected to the threaded shaft 15 and this assembly is joined to the gripper 20 by passing the upper end of the threaded shaft through hole 26 before handle 16 is connected to the top end of threaded shaft 15. The handle 16 preferably includes an annular shoulder 46 with an axial hole 47 which fits over the top end 45 of the threaded shaft 15. As the threaded shaft 15 is passed through the hole 26, projecting resilient tabs or stops 44 formed on shaft 15 pass through the hole 26. In this manner, the threaded shaft is free to turn relative to the gripper 20 by means of the collar 18, while the stops 44 prevent axial movement between the shaft 15 and gripper 20.

The gripper 20 also includes in the bridge portion 21 guideways 27 which receive the rods 12 of the frame assembly. Thus, the gripper slides upwardly and downwardly within the frame assembly and is prevented by rotation by engagement between the guideways 27 and the rods 12.

The bridge portion 21 of the gripper 20 is also preferably provided with grooves or lines of weakness 25 which form self hinges of the portions attached to the gripper arms 22, the purpose of which will be explained hereinafter.

The cork screw portion for removing traditional corks is shown by the numeral 50 and it has a cylindrical stem portion 51 with a handle 52 at the top end and a cork screw thread 53 at the bottom end. It also preferably includes a shoulder member 54 directly below the handle 52 for engaging the top face of threaded shaft handle 16. The stem 51 of cork screw 50 extends through axial holes in the handle 16, threaded shaft 15, bridge portion 21, mounting disc 41 and shoulder portion 42.

The manner in which the device of this invention may be used for removing a mushroom-shaped plastic stopper is shown in FIG. 2*a*. Thus, the handle 16 is rotated to move the gripper 20 to an upper position within the frame 10 and the frame is then placed over the end of a wine bottle and allowed to slide downwardly on the neck until the bottom ring 10 of the frame firmly engages the neck 40. The handle 16 is then turned causing the gripper 20 to move downwardly until the gripper teeth 23 have snapped below the shoulder portion 32 of the stopper 30.

The handle 16 is then rotated causing the gripper 20 to move upwardly and pulling the stopper 30 from the bottle. The stopper eventually releases from the bottle with a pop, but is prevented from flying because it is firmly held within the gripper arms 22 and the rods 12. Thus, it can move upwardly only the short distance until it abuts against the disc member 41.

The used stopper 30 is easily removed from the gripper simply by placing one's thumbs in the concave faces 24 of gripper arms 22 and spreading the arms apart so that the stopper falls out.

The use of the device of the invention for removing traditional corks from wine bottles is shown in FIGS. 1, 2 and 3. It can be seen that the cork screw portion 50 simply slides up and down within the hollow threaded shaft 15 so that when the device is being used to remove a mushroom-shaped plastic stopper as described above, the cork screw portion 50 is slid up out of the way of the action of the gripper 20 as illustrated in FIG. 2*a*. When the device is to be used to remove a cork 60 from a bottle 40, the frame is placed over the end of a wine bottle 40 and allowed to slide downwardly on the neck until the bottom ring 10 of the frame firmly engages the neck. The handle 16 is turned to move the disc 41 down close to the top of cork 60 and at this point the cork screw handle 52 is turned causing the threaded portion 53 to screw into the cork 60 as shown in FIG. 1. Now the handle 16 is turned causing the threaded shaft 15 to rotate with respect to the frame and forcing the handle 16 to thereby move in an upward direction relative to the bottle 40. This applies an axial upward force on the shoulder 54 of the cork screw 50 thereby pulling the cork 60 in an upward direction as shown in FIG. 2. When the cork 60 has released from the bottle, the device can be removed from the bottle as shown in FIG. 3. At this point, the cork screw handle 52 can be turned in a reverse direction to remove the threaded portion 53 from the cork 60.

The stopper pulling device of this invention has several important advantages over the prior art. Most importantly, it is extremely easy to use with the result that it will be used and not be relegated to being another useless gadget. Secondly, it is very simple and easy to manufacture, with the result that it can be sold at a price which can easily be afforded by anyone who can afford a bottle of wine. Finally, it is the only stopper removing device that is needed because it is equally useful for removing either traditional bottle corks or the mushroom-shaped plastic stoppers.

The present invention may be embodied in other specific forms without departing from its spirit or essential attributes. Accordingly, reference should be made to the following claims rather than the foregoing specification, as indicating the scope of the invention.

I claim:

1. A device for removing either a cork or a mushroom-shaped stopper from a bottle, comprising:

(a) a support frame having a bottom ring member adapted to engage the neck of a wine bottle, a top cap member with a threaded hole extending therethrough and at least two circumferentially spaced longitudinal support members extending between the top cap and bottom ring, (b) a threaded shaft having an upper end and a lower end mounted in said top cap threaded hole, this shaft having a handle mounted on the upper end thereof, (c) a stopper gripping and pulling member for a mushroom-shaped stopper comprising a bridge member connected to the lower end of said threaded shaft such that the threaded shaft is free to rotate relative to the bridge member while being fixed against relative axial movement, guideways in said bridge member for receiving said support frame longitudinal support members thereby preventing rotation of said bridge member, a pair of opposed stopper gripping arms extending downwardly from said bridge member, said gripping arms having at the lower ends thereof inwardly extending gripper dogs adapted to slide downwardly over the top of a mushroom-shaped stopper in a bottle and grip the stopper for pulling and these gripper arms being further adapted to swing outwardly from said bridge member to release a pulled stopper, and (d) a cork pulling member comprising a stem portion with a handle at one end and cork screw portion at the other end, said cork screw stem extending through an axial hole in said threaded shaft with the cork screw handle projecting above said threaded shaft handle, said cork screw member being adapted to be screwed into a cork in a bottle by turning the cork screw handle and being adapted to pull the cork from the bottle by turning the handle of the threaded shaft whereby the thread shaft handle engages the cork screw handle thereby lifting the cork screw and cork.

2. A device as claimed in claim 1 wherein a disc member is attached to the lower end of said threaded shaft, said disc having an axially upwardly extending collar which is received in a hole in said bridge member, permitting rotation of said shaft relative to the bridge member.

3. A device as claimed in claim 2 wherein the disc member is permanently fixed to the lower end of the threaded shaft.

4. A device as claimed in claim 3 wherein the bridge member is fixed against relative axial movement on said threaded shaft by means of resilient tabs projecting from said threaded shaft.

5. A device as claimed in claim 1 wherein the cork pulling member includes a shoulder portion below the handle thereof, said shoulder being adapted to press against the top of the handle of the threaded shaft while pulling a cork.

6. A device as claimed in claim 1 wherein the handle of the threaded shaft is detachably connected thereto.

* * * * *